US006582115B2

(12) United States Patent
Huang

(10) Patent No.: US 6,582,115 B2
(45) Date of Patent: Jun. 24, 2003

(54) STRUCTURE OF FIREWORK LIGHT

(75) Inventor: Peter K. H. Huang, Taipei (TW)

(73) Assignee: Shining Blick Enterprises Co., Ltd., Taipei (TW)

( * ) Notice: Subject to any disclaimer, the term of this patent is extended or adjusted under 35 U.S.C. 154(b) by 0 days.

(21) Appl. No.: 09/906,727

(22) Filed: Jul. 18, 2001

(65) Prior Publication Data

US 2003/0016544 A1 Jan. 23, 2003

(51) Int. Cl.[7] ..... F21S 4/00

(52) U.S. Cl. ..... 362/565; 362/252; 362/559; 362/806; 40/431

(58) Field of Search ..... 362/551, 554, 362/559, 565, 806, 252, 236, 811, 807, 567, 568, 227; 40/427, 428, 431, 442, 444, 540–41, 546–47, 550, 553, 581

(56) References Cited

U.S. PATENT DOCUMENTS 3,352,874 A * 11/1967 Rosenast ..... 546/186
5,031,085 A * 7/1991 Rustin ..... 248/123.2
5,400,534 A * 3/1995 Lin ..... 40/431
6,086,220 A * 7/2000 Lash et al. ..... 340/815.45

* cited by examiner

*Primary Examiner*—Sandra O'Shea
*Assistant Examiner*—John Anthony Ward
(74) *Attorney, Agent, or Firm*—Troxell Law Office PLLC

(57) ABSTRACT

A structure of firework light, wherein, a base is provided therein with an electric conductor and an automatic reeling device to lower the gravity of the firework light, and a post is provided to connect a hollow ball thereon, a lot of transparent radial rods are conveniently connected with the ball. An IC controller is provided in the hollow ball to separately control a flashlight, so that the IC controller makes the lamp strings in the radial rods flash sequentially after the flashlight flashes.

7 Claims, 6 Drawing Sheets

STRUCTURE OF FIREWORK LIGHT

BACKGROUND OF THE INVENTION

1. Field of the Invention

The present invention is related to a structure of firework light, and especially to such a structure of firework light of a larger type rendering the seat of the light more stable, the flashing effect of the light increased, and assembling of the radial rods of the firecracker light more convenient.

2. Description of the Prior Art

Conventional decorative lamps mostly have a lot of light beads on a lamp string, through control of the internal structure or electric circuit, the entire lamp string can provide the function of illumination or flashing. Modern lamp strings is variant in designing, including designing in cooperation with decorative articles of various fashions, or including making a plurality of lamp strings a form of curtain, this can be done by providing an IC program so that the curtain can give various changing motion patterns formed by flashing of the light.

The firework light of the larger type has a height of between 1.5 m to 3 m, while the stretching amplitudes of the radial rods provided on the post each is about 0.6 m to 1.8 m. Flashing of the decorative lamp looks like a general exploding firework, this firework effect is formed mainly by the radial rods on the top of the decorative lamp.

However, such firework light of the larger type has the following defect, i.e., by virtue that such firework light of the larger type generally is placed individually in an open area outdoors, stability of seating of such a conventional firework light is less desired. And more, the function of creating the firework is provided by direct driving the lamp strings for flashing on the radial rods, and is somewhat different from exploding of real fireworks. Further, a ball of the conventional firework light must be connected with a lot of radial rods. In the assembling structures of the radial rods now available, the radial rods are inconvenient for in-site assembling.

SUMMARY OF THE INVENTION

The object of the present invention is to provide a structure of firework light of a larger type, and is comprised of a base, a post mounted on the base, a ball provided on the top of the post, and a lot of transparent radial rods connected with the ball. The base is provided therein a lower transformer and an upper automatic reeling device. A separately controlled flashlight is provided at the center in the ball, the radial rods can be fast connected to the ball by providing male conductive connectors in cooperation with the insertion means provided on the ends of the radial rods and in cooperation with locking members. The flashlight provided at the center in the ball can separately flash to form an internal central exploding point, the radial rods can flash sequentially to thereby strengthen the effect of a real firework for the firework light.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
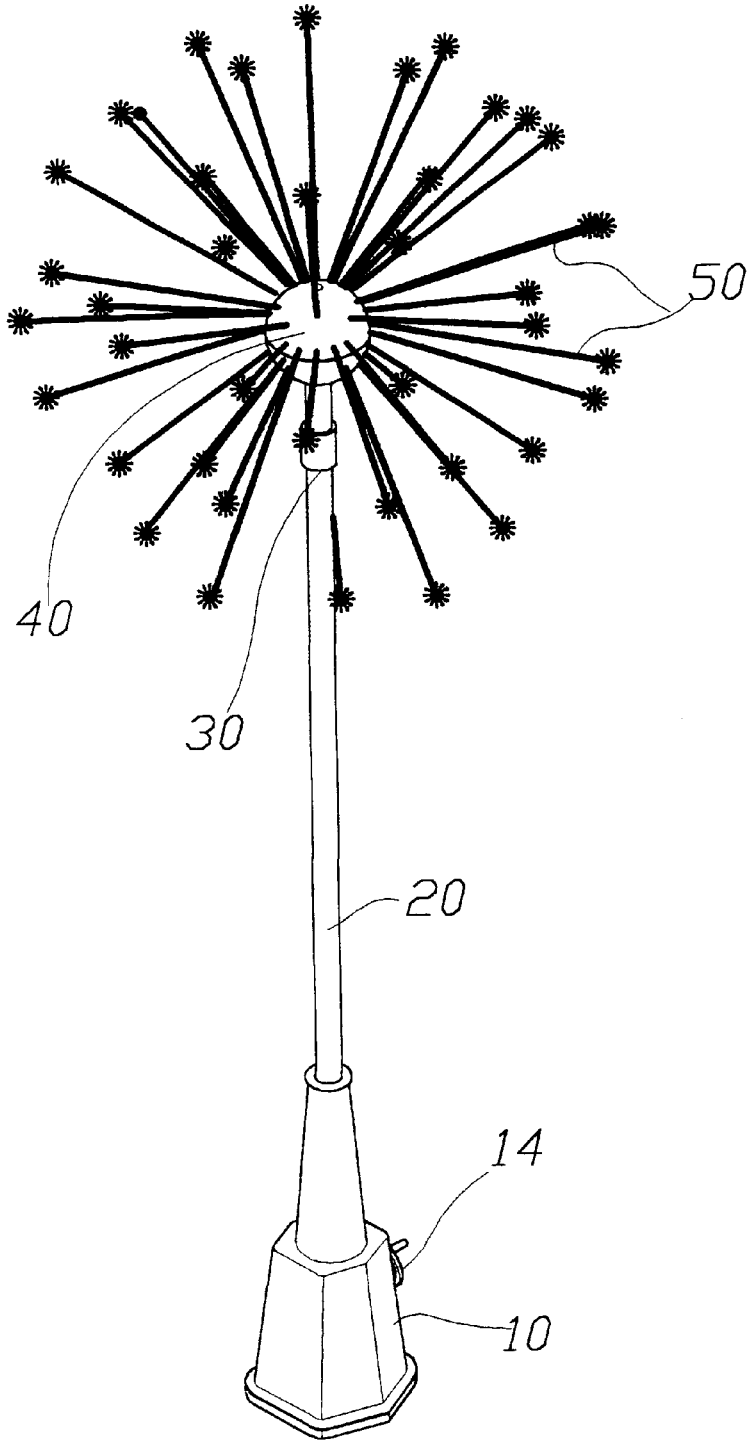
FIG. 1 is a perspective view of a preferred embodiment of the present invention.
Figure 2:
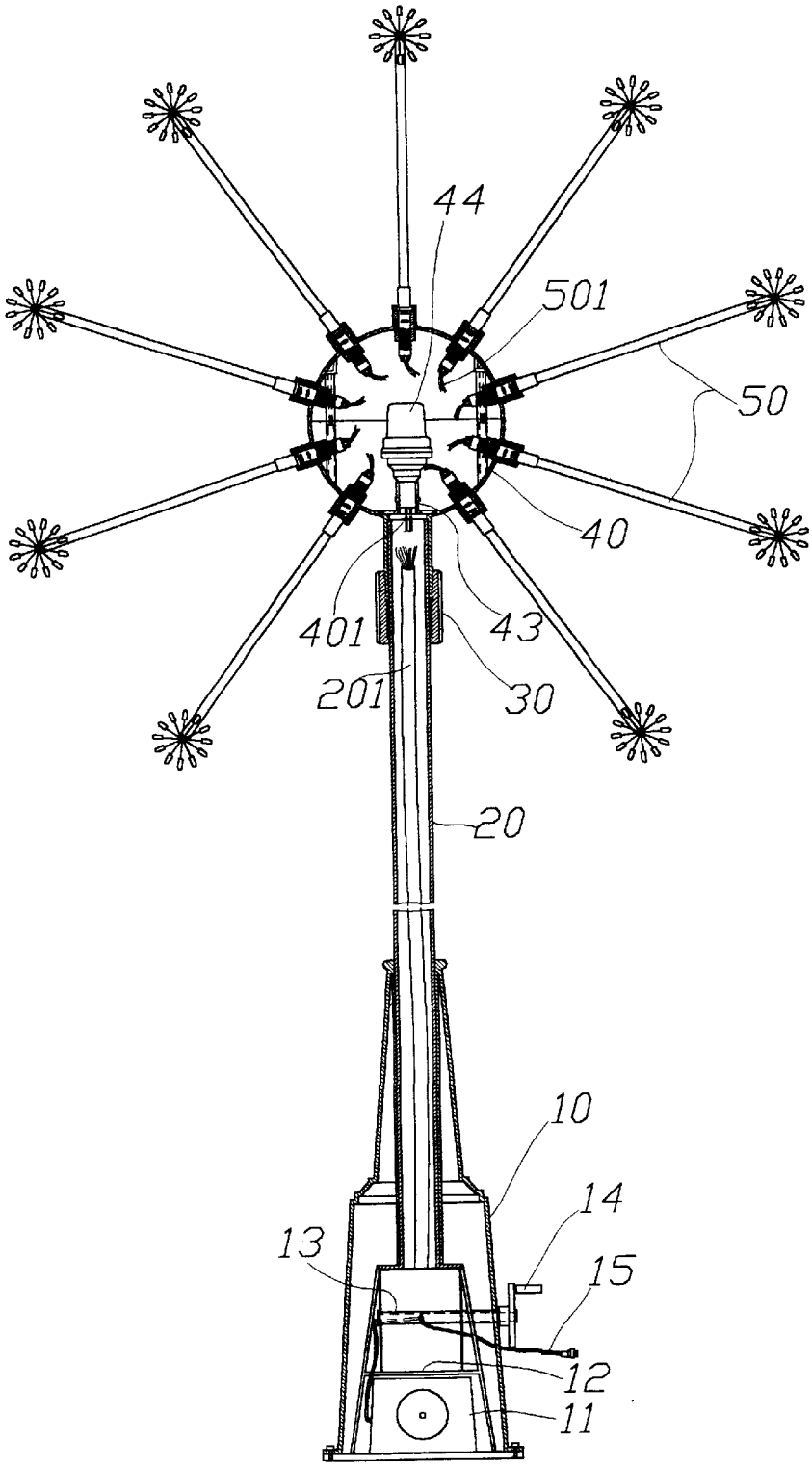
FIG. 2 is a sectional view taken from FIG. 1.

Referring to FIGS. 1, 2, the present invention is comprised of a hollow base 10 for seating, a post 20 of a predetermined length inserted in the base 10, a hollow ball 40 provided on the top of the post 20 connected by a connecting collar 30, and a lot of transparent radial rods 50 connected with the ball 40.

The base 10 is provided therein on the bottom thereof with an electric connecting means such as a transformer 11 with an IC controller 12 on the upper portion thereof, and is provided therein with an upper automatic reeling device 13 having a crank handle 14 for controlling reeling of an electric conductor 15. In this embodiment, although the transformer 11 is provided on the bottom to lower the gravity and to increase stability of the of the entire firework light, in another embodiment using a high voltage electric conductor, a weight can be placed at the bottom inside of the base 10.

Figure 3:
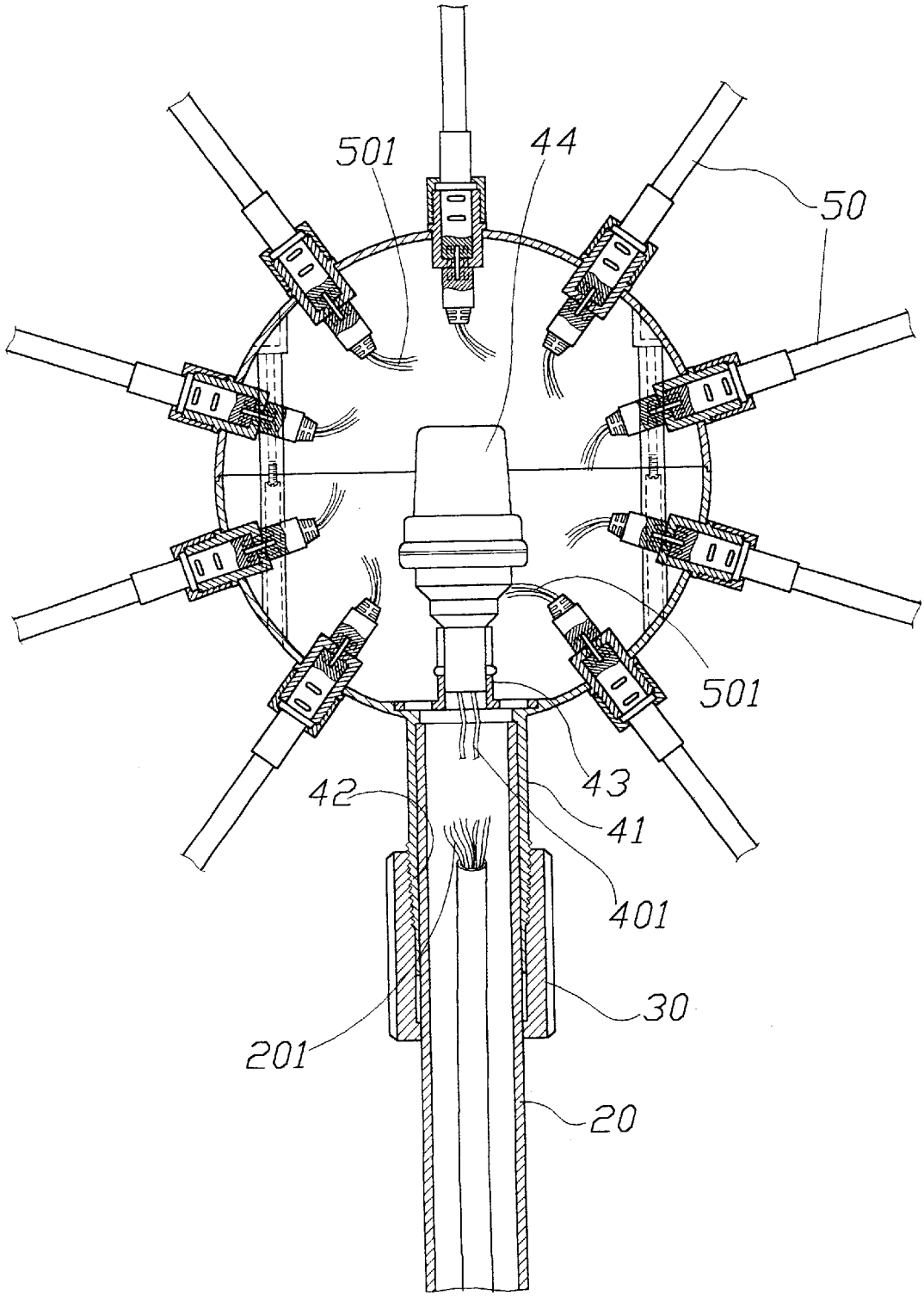
FIG. 3 is an enlarged sectional view taken from the upper portion in FIG. 2.
Figure 4:
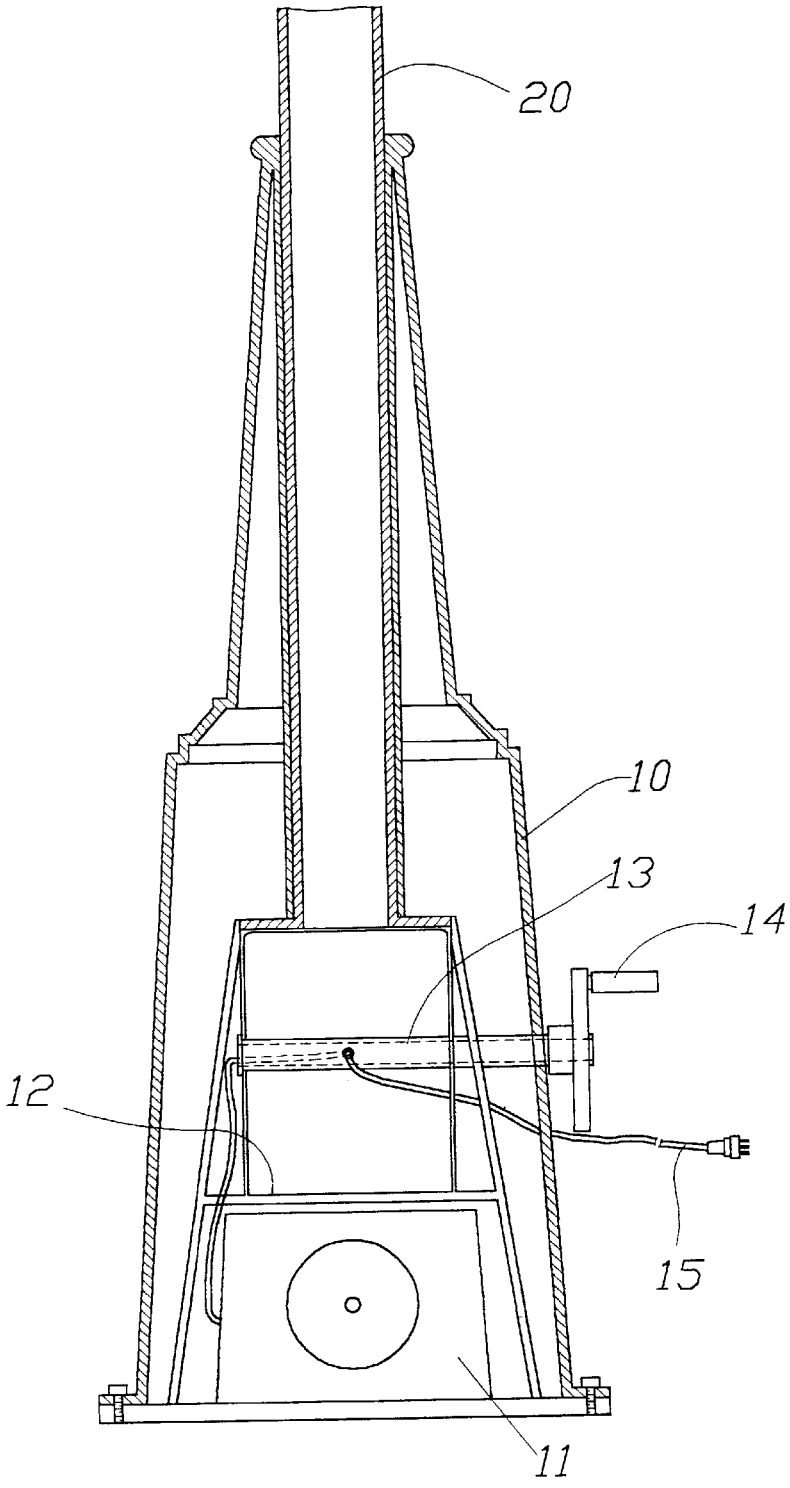
FIG. 4 is an enlarged sectional view taken from the lower portion in FIG. 2.

Referring to FIGS. 3 and 4, the hollow ball 40 in the abovementioned embodiment is formed from two semi-spherical bodies, while an extension sleeve 41 is provided on the bottom of the lower semi-spherical body. The post 20 has its partial lengths of the upper and the lower ends thereof inserted respectively into the extension sleeve 41 and the interior of the base 10. In the practicable embodiment, the sleeve 41 is provided with a threaded section 42 of a specific length, the connecting collar 30 having an internal thread is used for screw connecting to fix the ball 40 to the post 20.

Referring to FIGS. 2 and 3, a connecting seat 43 is provided at the junction of the lower semi-spherical body of the ball 40 and the post 20 for mounting a flashlight 44, so that the flashlight 44 generally is located at the center of the ball 40.

Figure 5:
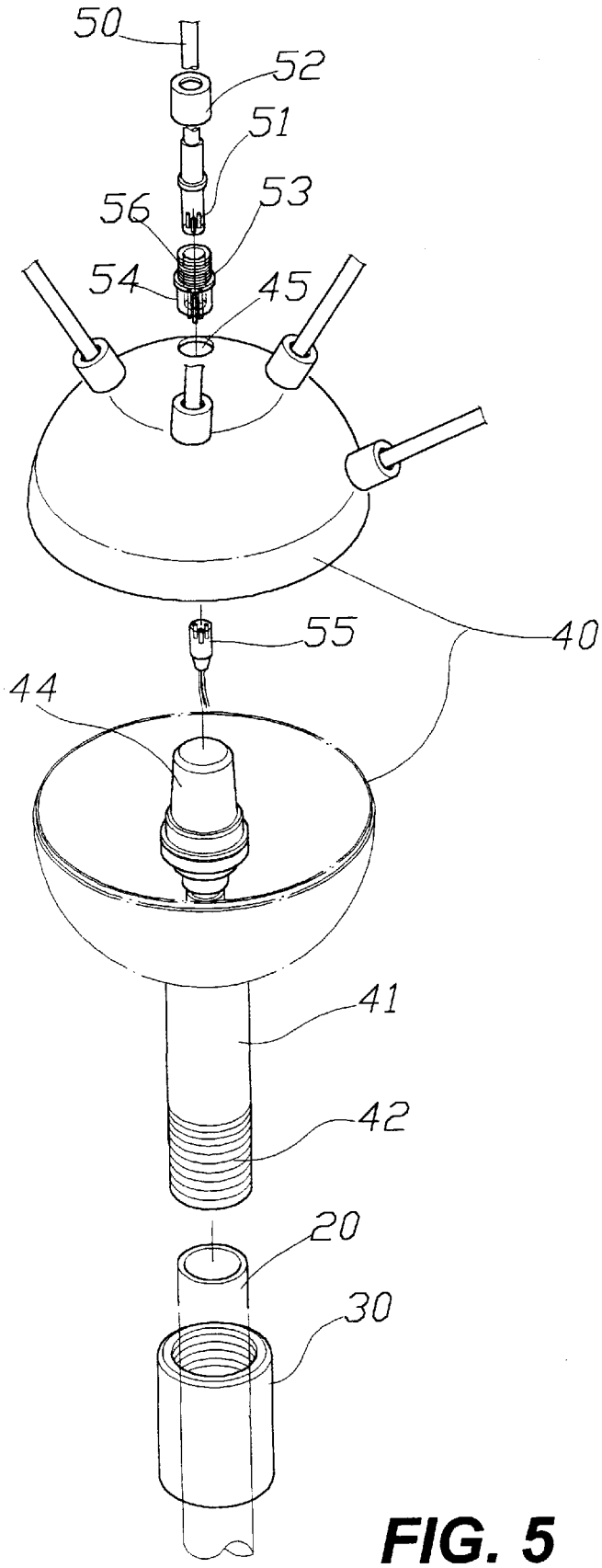
FIG. 5 is an enlarged analytical perspective view showing the ball member of FIG. 1.
Figure 6:
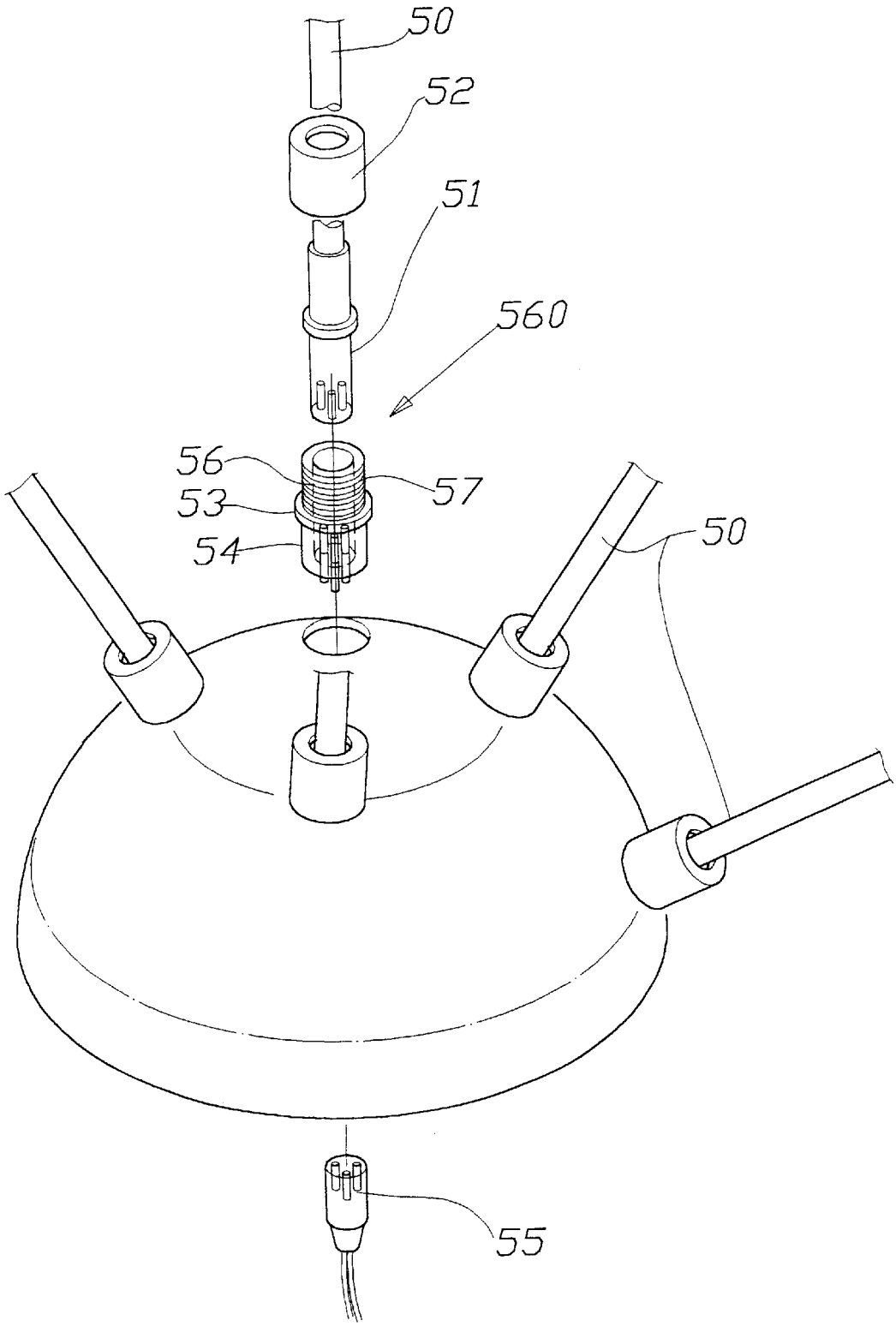
FIG. 6 is an enlarged sectional view taken from FIG. 5.

Referring to FIGS. 3, 5 and 6, the two semi-spherical bodies of the ball 40 can be provided with a lot of holes 45 for assembling a lot of radial rods 50 in the same number as that of the holes 45. Each radial rod 50 in principle is also a transparent hollow pipe for placing therein the required lamp string, and a female insertion end 51 and a locking nut 52 are provided therein too. An electric conductive male insertion member 54 including a stop flange 53 is connected with a hole 45 of the ball 40 with one end thereof exposed to the outside of the ball 40 while with the other end thereof extended into the ball 40 for connecting an electric conductive female insertion member 55. The exposing end of the male insertion member 54 can be insertion connected with the female insertion end 51 on the radial rod 50 by aiding of a leakage-proof ring 56; then the locking nut 52 is added for locking, and leakage-proof connection between the radial rod 50 and the ball 40 is completed.

Conductors 501 for all the radial rods 50 and a conductor 401 for the flashlight 44 are all connected via an internal main conductor 201 to the IC controller 12. The conductors are controlled to render the lamp strings in the radial rods 50 and the flashlight 44 to flash separately or sequentially,. this is a practicable technique well known by those skilled in the art and is not to be further narrated.

The structure of the present invention as stated above can make the lamp strings in the radial rods flash sequentially from inside outwardly after the flashlight flashes, i.e., the flash point of the present invention is generated at the center of the ball in advance, then the radial rods flash with an effect more like that of a real firework. And the heavier transformer is provided on the bottom of the firework light to lower the gravity and to effectively increase stability of the entire firework light; and more, assembling of the multiple radial rods can be faster and more convenient.

Having thus described my invention, what I claim as new and desire to be secured by Letters Patent of the United States are:

1. A structure of a firework light comprising:

a) a hollow base provided therein on a bottom thereof with an electric connecting cord and an IC controller;

b) a post having a main conductor, a lower end inserted into said hollow base and an upper end;

c) a hollow ball mounted to the upper end of said hollow post;

d) a plurality of radial rods removably connected to the hollow ball, each having a lamp string removably connected to said main conductor;

e) a flashing flashlight provided within and near a center of said hollow ball, the flashlight connected to said main conductor; and, f) a plurality of insertion members mounted on said hollow ball and removably connected with the plurality of radial rods so as to removably connect the radial rods to the hollow ball;

wherein said IC controller makes said lamp strings in said radial rods flash sequentially after said flashlight flashes.

2. The structure of a firework light as claimed in claim 1, further comprising a connecting seat provided at a junction of said hollow ball and said post for mounting said flashlight near said center of said ball.

3. The structure of a firework light as claimed in claim 1, further comprising an extension sleeve provided on a bottom of said hollow ball, said sleeve having a threaded section engaging a connecting collar for screw connecting said ball to said post.

4. The structure of a firework light as claimed in claim 1, further comprising an automatic reeling device in said base, said automatic reeling device having a crank handle for controlling reeling of the electric connecting cord.

5. The structure of a firework light as claimed in claim 1, wherein each of said radial rods is provided with a female insertion end and a locking nut, the insertion member includes a stop flange and is mounted to said ball with one end exposed to an outside of said ball connecting the female insertion end and the locking nut.

6. The structure of a firework light as claimed in claim 1, further comprising an electric conductor in said base having a transformer on a bottom to lower a center of gravity of said firework light.

7. The structure of a firework light as claimed in claim 1, further comprising a weight placed inside said base to lower a center of gravity of said firework light.

* * * * *